US006092938A

United States Patent [19]

Earle et al.

[11] Patent Number: 6,092,938

[45] Date of Patent: Jul. 25, 2000

[54] PROCESSING PHOTOGRAPHIC MATERIAL

[75] Inventors: Anthony Earle, Harrow Weald; Leslie R. Wells, Brentford, both of United Kingdom

[73] Assignee: Eastman Kodak Company, Rochester, N.Y.

[21] Appl. No.: 09/167,205

[22] Filed: Oct. 6, 1998

[30] Foreign Application Priority Data

Oct. 9, 1997 [GB] United Kingdom ..... 9721454

[51] Int. Cl.[7] ..... G03D 3/02

[52] U.S. Cl. ..... 396/626; 396/627

[58] Field of Search ..... 396/626, 627, 396/636, FOR 942; 101/424

[56] References Cited

U.S. PATENT DOCUMENTS 5,379,696 1/1995 Boehme et al. ..... 101/424

5,537,179 7/1996 Wernicke et al. ..... 396/627

FOREIGN PATENT DOCUMENTS 0 410 790 A2 1/1991 European Pat. Off. .

427403 5/1991 European Pat. Off. ..... 396/FOR 942

0 762 205 3/1997 European Pat. Off. .

11-102075 4/1999 Japan ..... 396/FOR 942

364414 10/1962 Switzerland .

*Primary Examiner*—D. Rutledge

*Attorney, Agent, or Firm*—Frank Pincelli

[57] ABSTRACT

Photographic processing apparatus feeds photographic material downwards between successive pairs of drive rollers. Processing solution is directed into the nips of the rollers. A nozzle at each end of the roller pairs directs compressed air into the nips so as to prevent the solution overflowing at the ends of the rollers.

12 Claims, 1 Drawing Sheet

PROCESSING PHOTOGRAPHIC MATERIAL

FIELD OF THE INVENTION

This invention relates to the processing, and particularly but not exclusively the washing or stabilizing, of photographic material, usually already exposed, in which the material passes through a plurality of stages.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of baths to stabilize and provide permanence to the image. Such baths convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. For convenience, this last-mentioned stage will hereinafter be referred to generically as "washing". Such stages remove residual chemicals and may also include conversion reactions between stabilizer solution components and materials within the coated layers. These stages are required to provide the required degree of permanence to the final image.

EP-A-0 762 205 and U.S. Pat. No. 5,537,179 disclose apparatus in which photographic material is washed using wash tanks. The photographic material is guided down into a wash tank through successive pairs of horizontally-disposed rollers, and water is directed downwardly into the nips thereof. A simple multi-stage washing device is thus obtained.

The application of washing liquid as exemplified in the above-mentioned publications results in the liquid flowing over the ends of the rollers rather than remaining in the nip, which leads to excessive quantities of liquid being used. Many solutions to this problem have been suggested, including the use of O-ring seals at the ends of the rollers, housings that fit tightly around the rollers, and convex or concave roller ends. All of these solutions, however, are mechanically complex and eventually result in unacceptable wear of the sliding or rolling surfaces. The use of magnetic fluids and magnetic containment is known, but this also results in a rather complex arrangement.

SUMMARY OF THE INVENTION

It is one object of the present invention to provide for photographic processing that prevents, or at least alleviates, the problem of liquid overflowing the ends of guide means, such as rollers.

In accordance with one aspect of the present invention, there is provided apparatus for processing photographic material, comprising:

guide means through which the material moves in a direction inclined to the horizontal, and preferably in a vertical direction;

means arranged to supply solution for processing the material to a nip in the upper side of the guide means; and restraining means arranged substantially to inhibit the solution from flowing beyond the ends of the guide means;

wherein the restraining means is arranged to direct fluid into the nip.

The guide means may comprise at least one pair of rollers, and may comprise a plurality of pairs located one above the other. Advantageously, the guide means are located substantially vertically above one another.

The restraining fluid, which may be a gas, preferably air, may be directed in a generally axial direction from the ends of the rollers, for example, as a jet.

In accordance with another aspect of the present invention, there is provided a method of processing photographic material, in which:

the material is moved in a direction inclined to the horizontal through guide means;

solution is supplied to a nip in the upper side of the guide means for processing the material; and in which fluid is directed into the nip so as substantially to inhibit overflow of the solution from the ends thereof.

Overflow of processing solution from the ends of the guide means is thus deterred in a particularly simple and convenient manner. Since no mechanical contact occurs, there is no surface wear and thus no need constantly to adjust for this. Photographic material of different widths can easily be accommodated, for example by changing the velocity of the restraining fluid and/or its point of impact on the processing solution.

The apparatus can conveniently be drained, simply by stopping the supply of the solution and of the fluid.

By avoiding unnecessary loss of processing solution, since it is confined to the contact area with the photographic material, less solution is needed, thus reducing initial cost and also minimizing effluent.

BRIEF DESCRIPTION OF THE DRAWINGS

Apparatus for, and a method of, processing photographic material, each in accordance with the present invention, will now be described, by way of example, with reference to the accompanying drawings, in which.

DETAILED DESCRIPTION OF THE INVENTION

Figure 2:
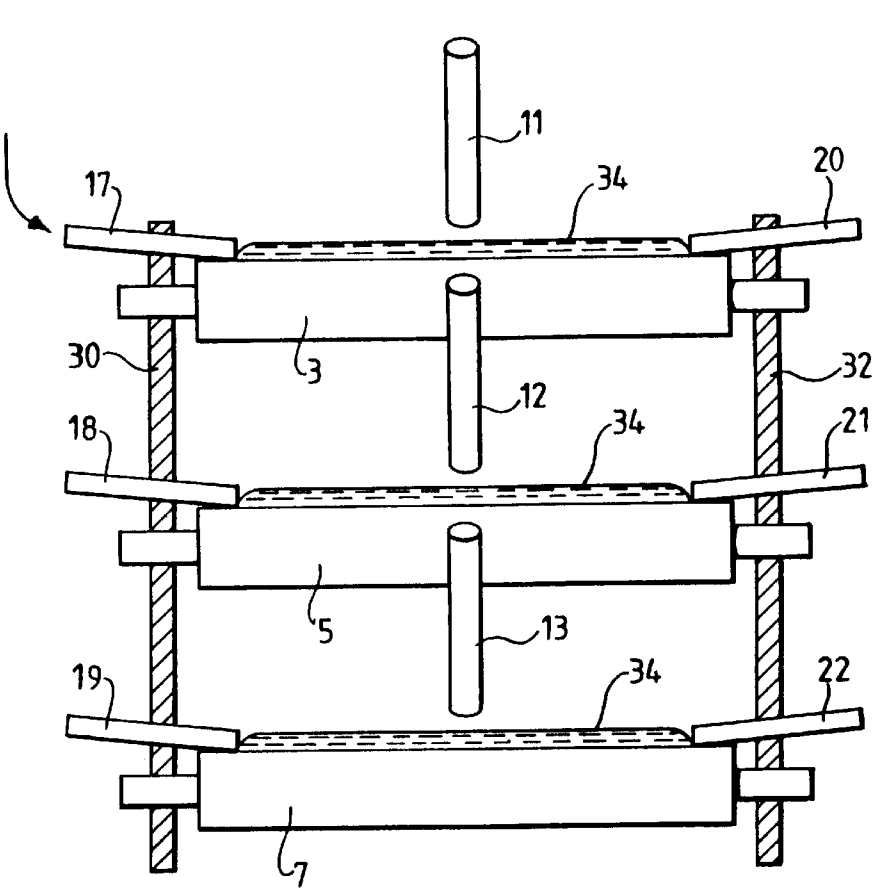
FIG. 2 is a front view of the apparatus of FIG. 1.
Figure 1:
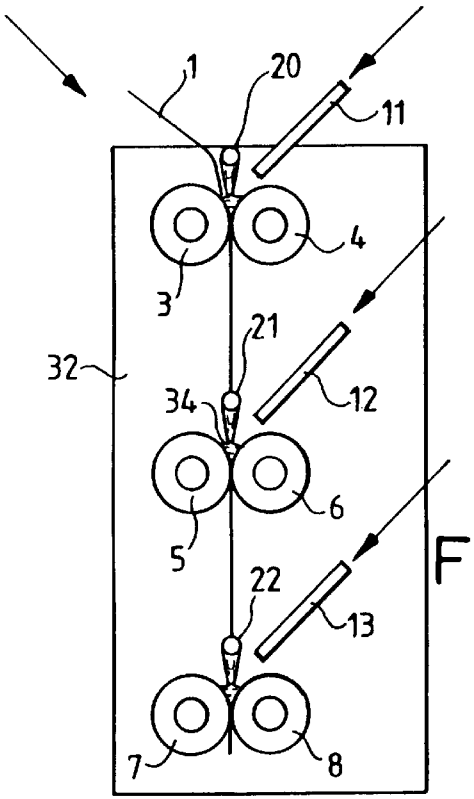
FIG. 1 is a schematic end view of the apparatus.

Referring to the figures, a web of exposed photographic film 1 to be washed is guided down into the nips of three pairs of drive rollers 3/4,5/6, and 7/8 disposed vertically above each other. The rollers rotate in bearings on side frames 30,32 of the apparatus. Solution 34 to wash the film 1 is delivered by pipes 11,12 and 13 into the nips of respective pairs of rollers. As an alternative, solution may be supplied only through the uppermost pipe 11 and allowed to cascade downwards (a) along the film 1 as it is transported through the apparatus, and (b) over the cylindrical roller surfaces. The solution rests in the nips and wets the film 1 as it passes therethrough. The major amount of the solution will be carried around the perimeter of the rotating rollers and flow to the rollers below, and finally into a catch tray (not shown).

The washing apparatus has a pair of nozzles 17/20, 18/21 and 19/22 associated with each pair of rollers 3/4, 5/6 and 6/7, respectively, which are directed into the roller nips from each end thereof. Compressed air is fed into the nozzles 17 to 22 and its velocity is adjusted so as to maintain the wash solution in a pool in the nips away from the ends of the rollers.

Figure 3:
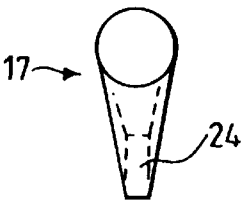
FIG. 3 is an enlarged view of a delivery nozzle of the apparatus.

It has been found that although small round pipes can be used, the air is more effective if it is brought in close to the nip and the solution. As can be seen from the enlarged view in FIG. 3 of one of the nozzles 17, the free end 24 of the nozzle has a flat narrow rectangular shape to facilitate this positioning. As an alternative to the rectangular shape, the free end may be V-shaped. In any instance, the most efficient shape for a given roller diameter, transport speed of the photographic material and solution viscosity may be arrived at by experiment. By varying the air velocity out of the nozzles, it is possible to alter the wetted area of the rollers, for example to accommodate different widths of photographic material passing through the apparatus.

Although the invention has been described with respect to the drawings in which the photographic material passes downwards through the rollers, it is envisaged that it is equally applicable to apparatus in which the material moves upwards, thus operating in a counter-current mode.

It is to be understood that various other changes and modifications may be made without departing from the scope of the present invention, the present invention being limited by the following claims.

What is claimed is:

1. Apparatus for processing photographic material comprising; guide means through which the material moves in a vertical direction; means arranged to supply solution for processing the material to a nip in the upper side of the guide means; and restraining means arranged substantially to inhibit the solution from flowing beyond the ends of the guide means; wherein the restraining means is arranged to direct gas into the nip.

2. Apparatus according to claim 1, wherein the guide means comprises at least one pair of rollers.

3. Apparatus according to claim 2, wherein the gas is directed in a generally axial direction from each end of the rollers.

4. Apparatus according to claim 1, comprising a plurality of guide means disposed, preferably vertically, one above each other, each of which is supplied with processing solution also being supplied with fluid as aforesaid.

5. Apparatus according to claim 1, wherein the gas is directed into the or each nip as a jet.

6. Apparatus according to claim 1, wherein the gas is air.

7. A method of processing photographic material, in which; the material is moved in a vertical direction through guide means; solution is supplied to a nip in the upper side of the guide means for processing the material; and in which fluid is directed into the nip so as substantially to inhibit overflow of the solution from the ends thereof.

8. A method according to claim 7, wherein the guide means comprises at least one pair of rollers, and the photographic material is passed therebetween.

9. A method according to claim 8, wherein the fluid is directed substantially axially from each end of the rollers.

10. A method according to claim 8, wherein the fluid is gas, preferably air.

11. A method according to claim 7, wherein more than one guide means is provided, one being disposed above another, wherein processing solution is supplied at least to an upper guide means and is allowed to run down the material between successive guide means.

12. A method according to claim 7, wherein the photographic material is arranged to move upwardly through the guide means and the processing solution is allowed to flow downwardly over the surface of the material between successive guide means.

* * * * *